US008237541B2

(12) United States Patent
Wang

(10) Patent No.: US 8,237,541 B2
(45) Date of Patent: Aug. 7, 2012

(54) BOTTLE CAP WITH LOCK

(76) Inventor: Chiu Sung Wang, Taichung (TW)

( * ) Notice: Subject to any disclaimer, the term of this patent is extended or adjusted under 35 U.S.C. 154(b) by 304 days.

(21) Appl. No.: 12/754,624

(22) Filed: Apr. 6, 2010

(65) Prior Publication Data

US 2011/0241828 A1 Oct. 6, 2011

(51) Int. Cl.
*G08B 21/00* (2006.01)

(52) U.S. Cl. ..... 340/5.53; 340/5.52; 340/5.83; 340/5.2; 340/5.31; 700/213; 700/214; 221/7; 70/63

(58) Field of Classification Search ..... 340/5.2, 340/5.31, 5.52, 5.53, 5.83; 700/213, 214; 221/7; 70/63
See application file for complete search history.

(56) References Cited

U.S. PATENT DOCUMENTS 6,382,416 B1 * 5/2002 Gainey ..... 206/317
7,961,914 B1 * 6/2011 Smith ..... 382/115
2002/0147525 A1 * 10/2002 Cayne et al. ..... 700/214
2004/0133304 A1 * 7/2004 Fobbe et al. ..... 700/214
2006/0231109 A1 * 10/2006 Howell et al. ..... 128/898
* cited by examiner

*Primary Examiner* — Jennifer Mehmood
*Assistant Examiner* — Mark Rushing
(74) *Attorney, Agent, or Firm* — Muncy, Geissler, Olds & Lowe, PLLC

(57) ABSTRACT

A bottle cap includes a reservoir; a screw cap; a magnetic lock comprising a magnetically actuated spring bolt on the reservoir, and a hole on the cap; a fingerprint scanner on the reservoir; and a battery powered controller on bottom of the reservoir for fingerprint identification and fingerprint storing. In response to placing a finger on the fingerprint scanner, the fingerprint scanner and the controller are activated, the fingerprint scanner captures a fingerprint from the finger and converts the fingerprint into digital signals which are sent to the controller, the controller compares the digital signals with the fingerprint record(s), if matching the bolt will be compressed to clear the hole with the clearing being kept for a time to disengage the cap from the reservoir, and thereafter the controller and the fingerprint scanner will be deactivated and the bolt will bounce back to its locked position.

3 Claims, 6 Drawing Sheets

BOTTLE CAP WITH LOCK

BACKGROUND OF THE INVENTION

1. Field of Invention

The invention relates to bottles and more particularly to a tamper resistant bottle having a cap which can be opened only after being validated by a fingerprint scanner and an immediately next unlocking of a magnetic lock.

2. Description of Related Art

Secure caps for containers of various substances are encountered frequently. Various designs for child-proofing medicine bottles and cleaning supplies rely on strength and complex manipulation to keep potent medicines and corrosive chemicals out of the mouths of children.

A type of bottle having a cap with a lock based on a clutching mechanism and using a key or combination lock is commercially available.

However, conventional secure caps for containers are complicated in locking mechanism and are not appropriate for bottles or vials identified with pharmacies prescription filling or other common drinking bottles. Thus, the need for improvement still exists.

SUMMARY OF THE INVENTION

It is therefore one object of the invention to provide a bottle comprising a reservoir adapted to contain a quantity of liquid and comprising an externally threaded neck; a cap comprising internal threads adapted to secure to the neck; a magnetic lock comprising a magnetically actuated spring bolt formed on an upper edge of the reservoir, and a hole formed on a lower edge of the cap, the hole being shaped to allow the bolt to insert into or leave; a fingerprint scanner formed on an outer surface the reservoir; and a battery powered controller releasably mounted on bottom of the reservoir for fingerprint identification and storing at least one record of fingerprint wherein in a locked position, the cap is secured to the reservoir and the bolt is inserted into the hole, and wherein in response to placing a finger on the fingerprint scanner, the fingerprint scanner is activated and the controller is activated by the fingerprint scanner, the fingerprint scanner captures a fingerprint from the finger and converts the fingerprint into digital signals which are sent to the controller, the controller compares the digital signals with the at least one record of fingerprint, if there is a match the bolt will be compressed to clear the hole with the clearing being kept for a predetermined period of time to disengage the cap from the reservoir, and after the predetermined period of time being elapsed, the controller and the fingerprint scanner will be deactivated and the bolt will bounce back to its locked position.

The above and other objects, features and advantages of the invention will become apparent from the following detailed description taken with the accompanying drawings.

DETAILED DESCRIPTION OF THE INVENTION

Figure 1:
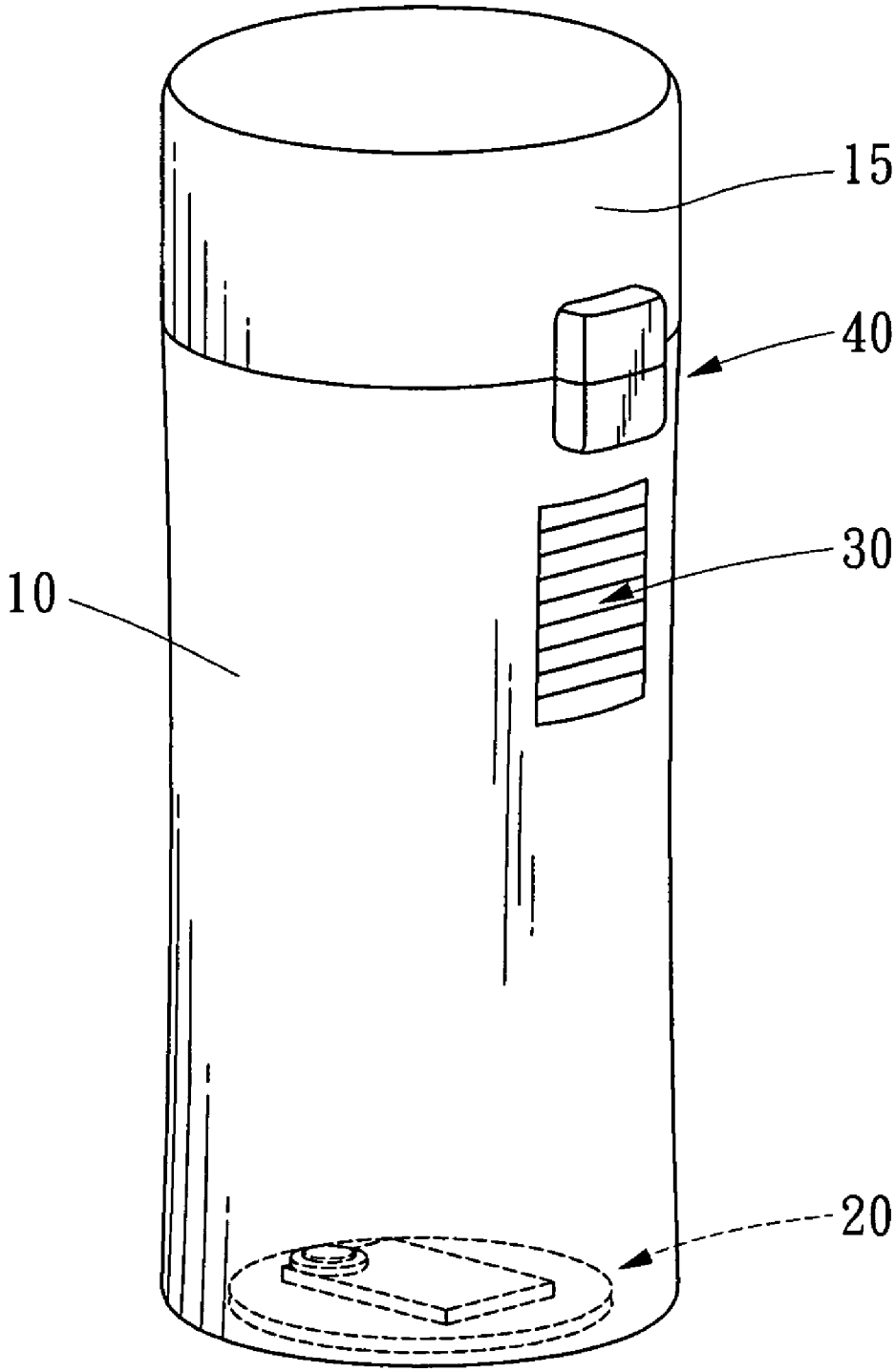
FIG. 1 is a perspective view of a safety bottle according to a first preferred embodiment of the invention.
Figure 2:
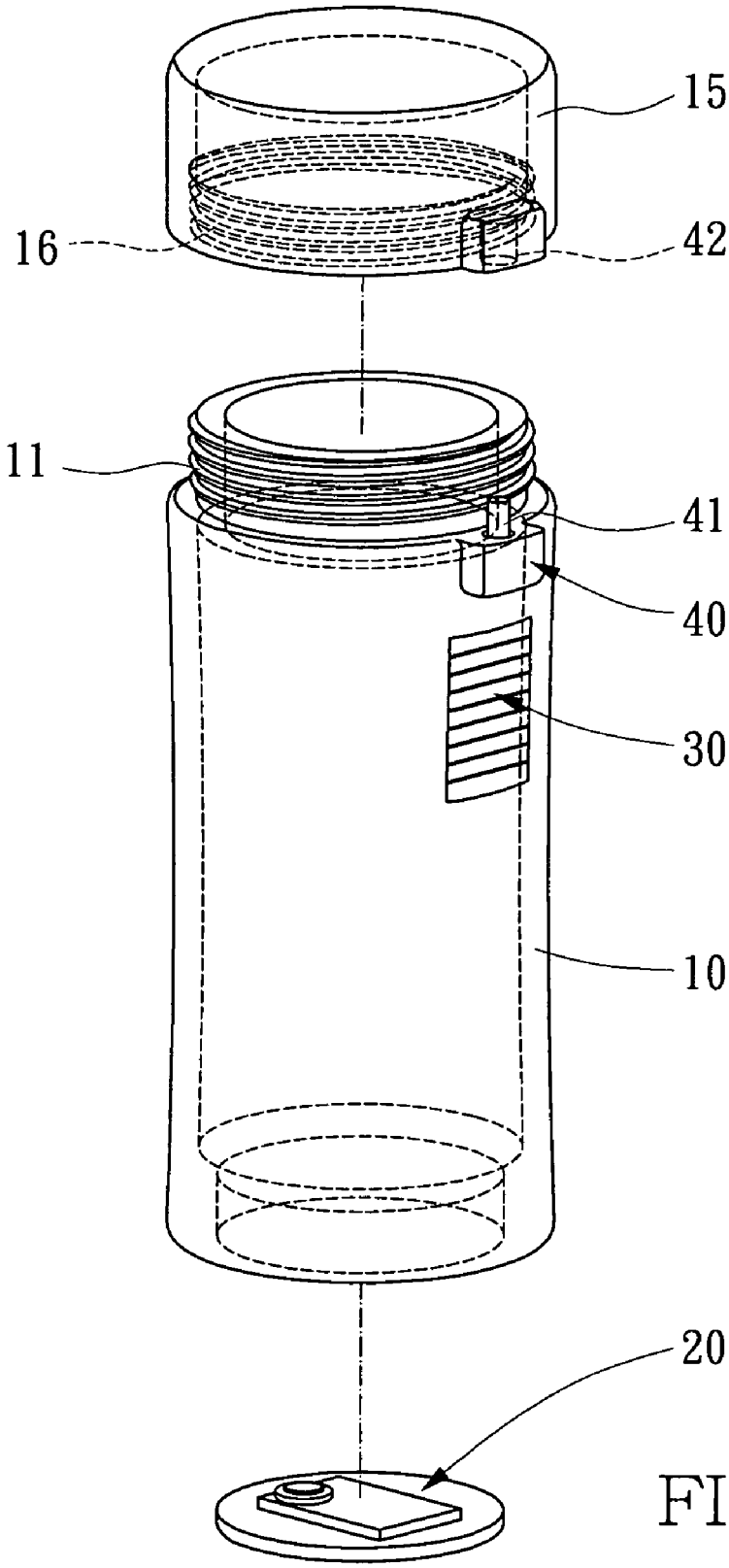
FIG. 2 is an exploded view of the bottle shown in FIG. 1.
Figure 3:
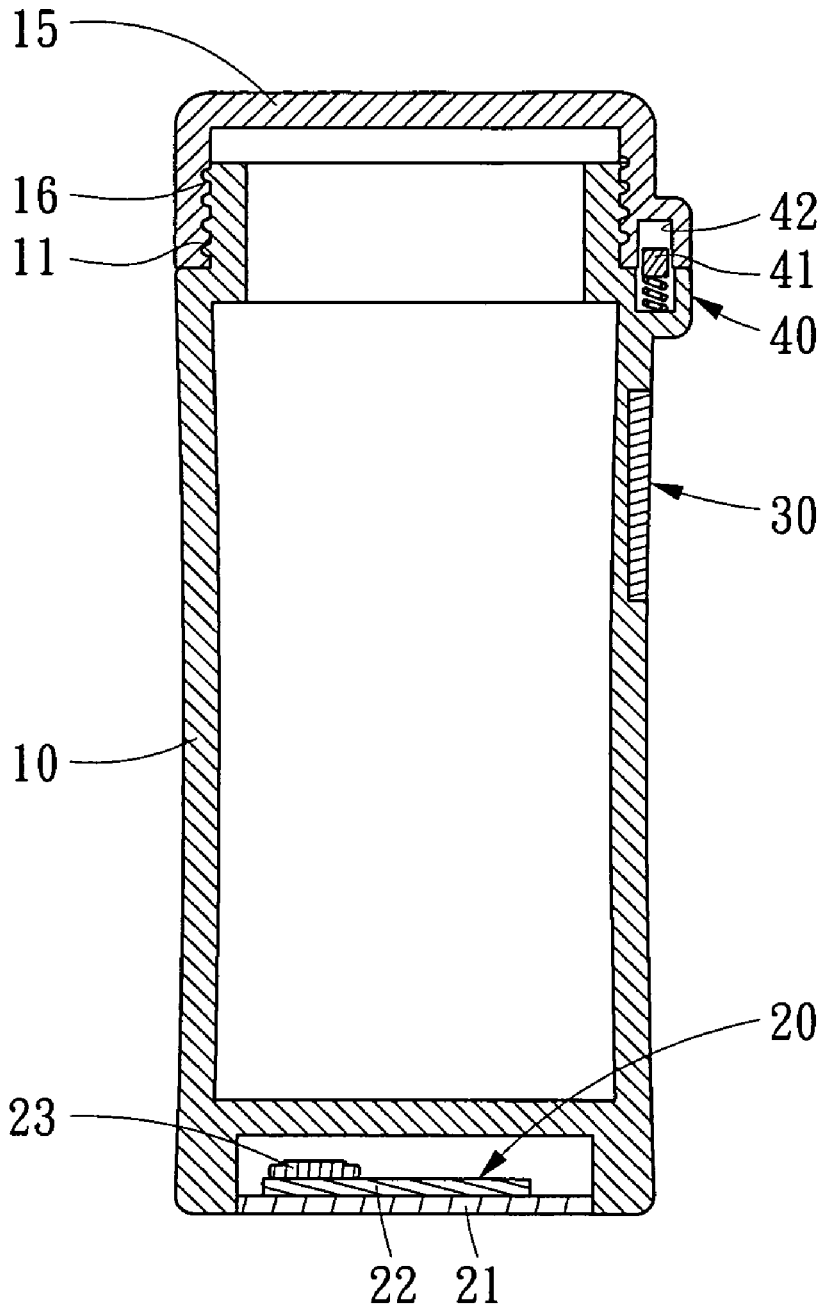
FIG. 3 is a longitudinal sectional view of the bottle of FIG. 1.

Referring to FIGS. 1 to 3, a safety bottle in accordance with a first preferred embodiment the invention comprises the following components as discussed in detail below.

A cylindrical reservoir 10 is adapted to contain a quantity of liquid (e.g., pharmacies prescription filling). The reservoir 10 has an externally threaded neck 11. A cylindrical cap 15 has internal threads 16 adapted to secure to the neck 11. A magnetic lock 40 comprises a magnetically actuated spring bolt 41 formed on a periphery of the reservoir 10 proximate to a shoulder portion between the body of the reservoir 10 and the neck 11. The lock 40 further comprises a hole 42 formed on a lower edge of an outer surface of the cap 15. The hole 42 is shaped to complimentarily receive the bolt 41 and allow the bolt 41 to insert into or leave in a smooth manner.

A rectangular fingerprint scanner 30 is formed on the periphery of the reservoir 10 below the lock 40. A controller 20 comprises a disc 21 releasably mounted on the mouth of a recessed bottom of the reservoir 10 so that a flat bottom of the reservoir 10 is formed. The controller 20 further comprises a printed circuit board (PCB) 22 fixedly formed on the disc 21. Electronics for controlling the fingerprint identification operation of the controller 20 is provided on the PCB 22. Also, a memory for storing at least one record of fingerprint is provided on the PCB 22 so that any person having a fingerprint matched with that stored in the memory of the PCB 22 will be allowed to open the cap 15 as detailed later. The controller 20 further comprises a battery (e.g., rechargeable battery) 23 on the PCB 22 for supply power to the PCB 22 and the lock 40 for their normal operations.

In a locked position, the cap 15 is secured to the reservoir 10 and the bolt 41 is inserted into the hole 42. For opening the lock 40, a person has to put his or her finger on the fingerprint scanner 30 which is thus activated due to temperature of the finger. The controller 20 is immediately activated as enabled by the controller 20. And in turn, the fingerprint scanner 30 scans the fingerprint and converts same into digital signals which are in turn sent to the controller 20. The controller 20 then may compare the digital signals with the at least one record of fingerprint. Preferably, four seconds is required for the fingerprint identification process.

If there is a match the bolt 41 will be actuated to compress its spring until the bolt 41 clears the hole 42. Preferably, the bolt 41 may clear the hole 42 for five seconds. That is, the person has to use the finger or a tool to press down the bolt 41 within five seconds so that he or she can unfasten (i.e., open) the cap 15 by counterclockwise turning the cap 15. After five seconds lapsed, the fingerprint scanner 30 will be deactivated and the magnetically actuated spring bolt 41 will bounce back to its projecting position due to the interrupt of power supply from the battery 23 via PCB 22 (see FIGS. 2 and 3).

A possible reason for the malfunction of the bottle is battery too low. Therefore, a frequent replacement of battery is required depending on the use times and other factors. The safety bottle aims at preventing itself from being inadvertently opened by a child. Also, the safety bottle aims at preventing itself from being opened by any unauthorized persons who may maliciously drop toxic material into the bottle.

Figure 4:
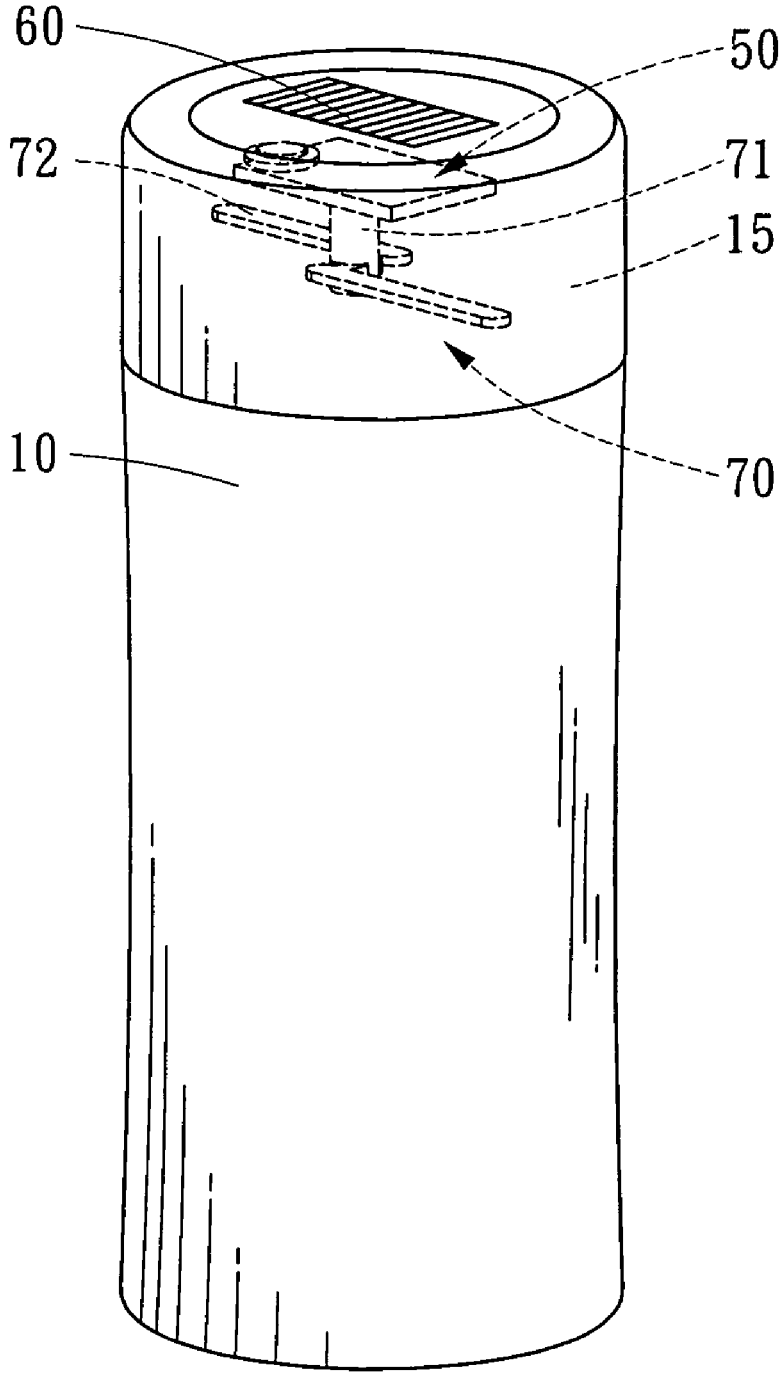
FIG. 4 is a perspective view of a safety bottle according to a second preferred embodiment of the invention.
Figure 5:
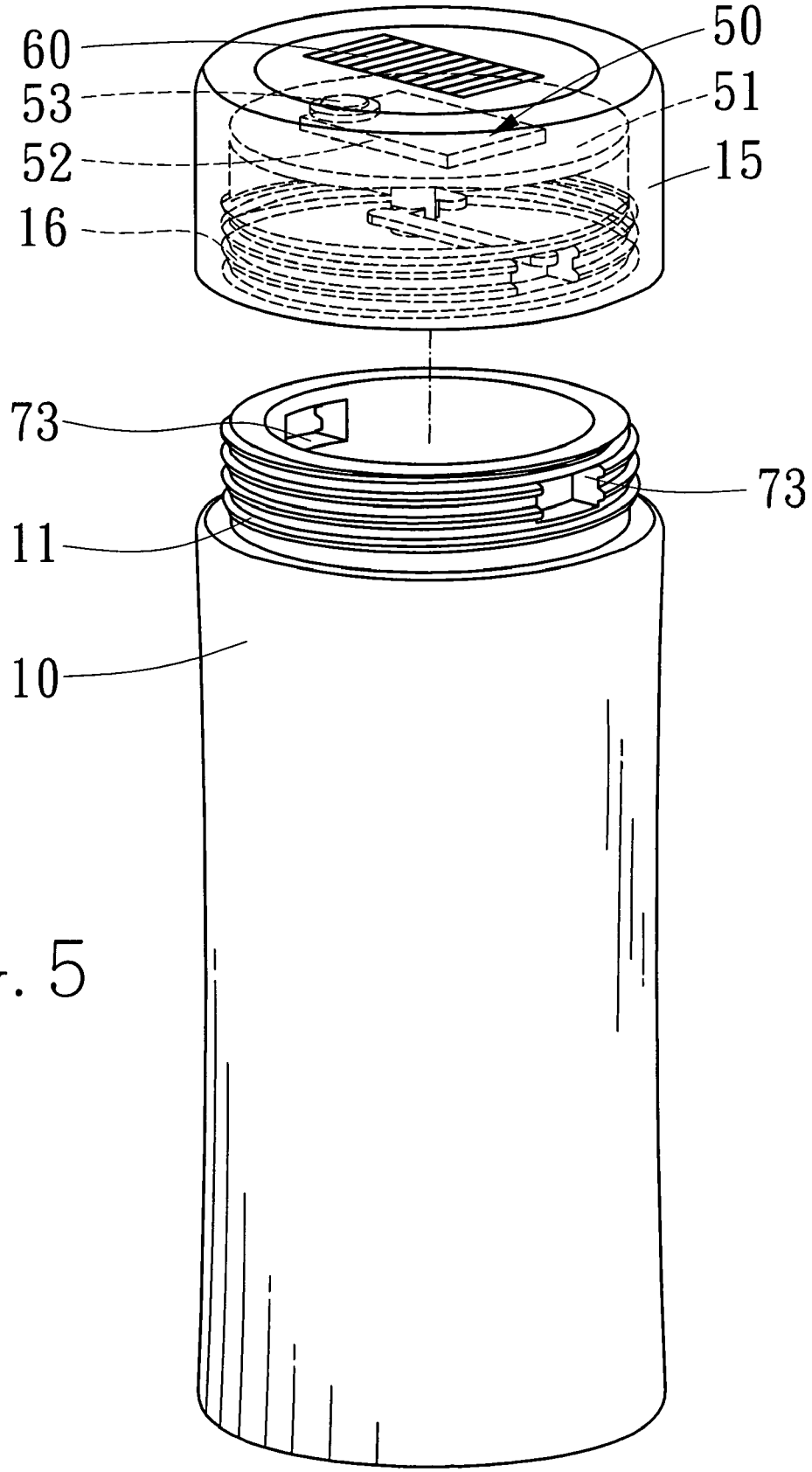
FIG. 5 is an exploded view of the bottle shown in FIG. 4.
Figure 6:
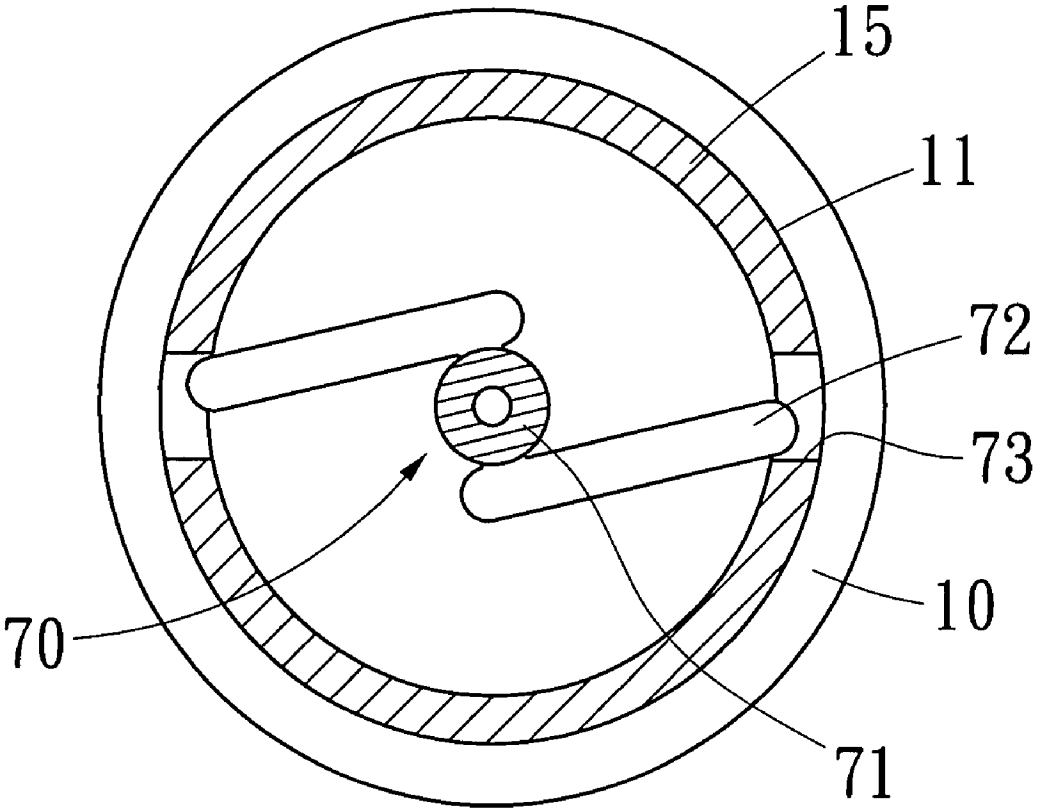
FIG. 6 is a cross-sectional view of the bottle cap of FIG. 4.

Referring to FIGS. 4 to 6, a safety bottle in accordance with a second preferred embodiment the invention comprises the following components as discussed in detail below.

A cylindrical reservoir 10 is adapted to contain a quantity of liquid (e.g., pharmacies prescription filling). The reservoir 10 has an externally threaded neck 11. Two opposite openings 73 are formed in the neck 11. A cylindrical cap 15 has internal threads 16 adapted to secure to the neck 11. A rectangular fingerprint scanner 60 is provided on top of the cap 15. A controller 50 comprises a disc 51 releasably mounted on an inner surface of the cap 15 and a PCB 52 fixedly mounted on top of the disc 51. Electronics for controlling the identification operation of the controller 50 is provided on the PCB 52. Also, a memory for storing at least one record of fingerprint is provided on the PCB 52 so that any person having a fingerprint matched with that stored in the memory of the PCB 52 will be allowed to open the cap 15 as detailed later.

The controller 50 further comprises a battery (e.g., rechargeable battery) 53 on top of the PCB 52 for supply power to the PCB 52 and a magnetic lock 70 for their normal operations. The magnetic lock 70 comprises a magnetically actuated pivot post 71 pivotably formed on a bottom center of the disc 51, and two parallel offset bars 72 each having one end secured to the pivot post 71 and the other end disposed in the opening 73 in a locked position of the bottle.

For opening the lock 70, a person has to put his or her finger on the fingerprint scanner 60. The fingerprint scanner 60 may be activated due to temperature of the finger. The controller 20 is immediately activated as enabled by the fingerprint scanner 60. The fingerprint scanner 60 scans the fingerprint and converts same into digital signals which are in turn sent to the controller 50. The controller 50 then may compare the digital signals with the at least one record of fingerprint. Preferably, four seconds is required for the fingerprint identification process.

If there is a match the pivot post 71 will be actuated to counterclockwise pivot a predetermined angle until the bars 72 clear the openings 73. Moreover, preferably, the clearing of the bars 72 lasts for five seconds. That is, the person has to use the hand to unfasten (i.e., open) the cap 15 in five seconds by counterclockwise turning the cap 15. After five seconds being lapsed, the fingerprint scanner 60 will be deactivated and the magnetically actuated pivot post 71 will clockwise pivot back to dispose the other ends of the bars 72 in the openings 73 again in the locked position due to the interrupt of power supply from the battery 53 via PCB 52.

In a third preferred embodiment, only a bar 72 and a corresponding opening 73 are provided.

While the invention herein disclosed has been described by means of specific embodiments, numerous modifications and variations could be made thereto by those skilled in the art without departing from the scope and spirit of the invention set forth in the claims.

What is claimed is:

1. A bottle comprising:

a reservoir adapted to contain a quantity of liquid and comprising an externally threaded neck;

a cap comprising internal threads adapted to secure to the neck;

a magnetic lock comprising a magnetically actuated spring bolt disposed on an upper edge of the reservoir, and a hole formed on a lower edge of the cap, the hole being shaped to allow the bolt to insert into or leave;

a fingerprint scanner disposed on an outer surface the reservoir; and a battery powered controller releasably mounted on bottom of the reservoir for fingerprint identification and storing at least one record of fingerprint, wherein in a locked position, the cap is secured to the reservoir and the bolt is inserted into the hole; and wherein in response to placing a finger on the fingerprint scanner, the fingerprint scanner is activated and the controller is activated by the fingerprint scanner, the fingerprint scanner captures a fingerprint from the finger and converts the fingerprint into digital signals which are sent to the controller, the controller compares the digital signals with the at least one record of fingerprint, if there is a match the bolt will be compressed to clear the hole with the clearing being kept for a predetermined period of time to disengage the cap from the reservoir, and after the predetermined period of time being elapsed, the controller and the fingerprint scanner will be deactivated and the bolt will bounce back to its locked position.

2. A bottle comprising:

a reservoir adapted to contain a quantity of liquid and comprising an externally threaded neck including two opposite openings;

a cap comprising internal threads adapted to secure to the neck;

a battery powered controller releasably mounted in the cap for fingerprint identification and storing at least one record of fingerprint, a magnetic lock comprising a magnetically actuated pivot post extending downward from the controller, and two parallel offset bars each having one end secured to the pivot post and the other end disposed in the opening in a locked position of the bottle; and a fingerprint scanner disposed on top of the reservoir;

wherein in a locked position, the cap is secured to the reservoir; and wherein in response to placing a finger on the fingerprint scanner, the fingerprint scanner is activated and the controller is activated by the fingerprint scanner, the fingerprint scanner captures a fingerprint from the finger and converts the fingerprint into digital signals which are sent to the controller, the controller compares the digital signals with the at least one record of fingerprint, if there is a match the pivot post will be actuated to counterclockwise pivot to cause the bars to clear the openings with the clearing being kept for a predetermined period of time to disengage the cap from the reservoir, and after the predetermined period of time being elapsed, the controller and the fingerprint scanner will be deactivated and the pivot post will clockwise pivot to dispose the bars in the locked position.

3. A bottle comprising:

a reservoir adapted to contain a quantity of liquid and comprising an externally threaded neck including an opening;

a cap comprising internal threads adapted to secure to the neck;

a battery powered controller releasably mounted in the cap for fingerprint identification and storing at least one record of fingerprint, a magnetic lock comprising a magnetically actuated pivot post extending downward from the controller, and a bar having one end secured to the pivot post and the other end disposed in the opening in a locked position of the bottle; and a fingerprint scanner disposed on top of the reservoir;

wherein in a locked position, the cap is secured to the reservoir; and wherein in response to placing a finger on the fingerprint scanner, the fingerprint scanner is activated and the controller is activated by the fingerprint scanner, the fingerprint scanner captures a fingerprint from the finger and converts the fingerprint into digital signals which are sent to the controller, the controller compares the digital signals with the at least one record of fingerprint, if there is a match the pivot post will be actuated to counter-clockwise pivot to cause the bar to clear the opening with the clearing being kept for a predetermined period of time to disengage the cap from the reservoir, and after the predetermined period of time being elapsed, the controller and the fingerprint scanner will be deactivated and the pivot post will clockwise pivot to dispose the bar in the locked position.

* * * * *